US006052917A

United States Patent [19]

Matsumoto

[11] Patent Number: 6,052,917

[45] Date of Patent: Apr. 25, 2000

[54] VACUUM ROTARY DRYER

[75] Inventor: Takashi Matsumoto, Sakai, Japan

[73] Assignee: Matsumoto Machine Mfg. Co., Ltd., Osaka, Japan

[21] Appl. No.: 09/117,812

[22] PCT Filed: Dec. 10, 1997

[86] PCT No.: PCT/JP97/04543

§ 371 Date: Aug. 10, 1998

§ 102(e) Date: Aug. 10, 1998

[87] PCT Pub. No.: WO98/26244

PCT Pub. Date: Jun. 18, 1998

[30] Foreign Application Priority Data

Dec. 11, 1996 [JP] Japan ..... 8-330624

[51] Int. Cl.[7] ..... F26B 11/04

[52] U.S. Cl. ..... 34/138; 34/140; 34/141; 432/108

[58] Field of Search ..... 34/524, 558, 559, 34/563, 565, 135, 138, 139, 141, 142, 603, 605, 606, 134; 432/103, 107, 108, 117; 110/226

[56] References Cited

U.S. PATENT DOCUMENTS 4,071,229 1/1978 Domazer et al. ..... 266/173
4,864,942 9/1989 Fochtman et al. ..... 110/226
5,517,004 5/1996 Blonk ..... 219/652

FOREIGN PATENT DOCUMENTS 6-42867 2/1994 Japan .
7-94027 1/1995 Japan .

*Primary Examiner*—Pamela A. Wilson
*Attorney, Agent, or Firm*—Pollock, Vande Sande & Amernick

[57] ABSTRACT

A vacuum rotary dryer capable of charging solids into a rotary drum and discharging the solids from the rotary drum without any manual operation contacting solids with the hands is provided. A rotary drum (23) is mounted thereon with a gas flow pipe (46) and a solids feed and discharge pipe (56). The solids feed and discharge pipe (56) is connected to a feed source of the solids and a pressure reducing unit (53) reduces a pressure in the rotary drum through the gas flow pipe (46), to thereby feed solids to be dried to the rotary drum (23). After drying of solids in the drum, the solids feed and discharge pipe (56) is connected to a solids suction and transport structure and the gas flow pipe (46) is rendered open to an atmospheric pressure. A swing section (56*b*) of the solids feed and discharge pipe (56) is pivotally moved, to thereby be intruded into solids while keeping the rotary drum (23) inclined, resulting in solids being removed through a distal end of the swing section by suction. Finally, the distal end of the swing section (56*b*) is rendered opposite to a lowermost portion of the rotary drum to remove substantially all solids in the rotary drum therefrom.

6 Claims, 5 Drawing Sheets

VACUUM ROTARY DRYER

TECHNICAL FIELD

This invention relates to a vacuum rotary dryer suitable for use for drying particulate solids.

BACKGROUND ART

A vacuum rotary dryer generally includes a rotary drum including a jacket of a double peripheral wall structure in which hot water is flowed to heat it and a pressure reducing unit for reducing a pressure in the rotary drum and is adapted to dry a material to be treated or dried (or treated or dried material) which is received in the rotary drum while reducing a pressure in the rotary drum.

Such a vacuum rotary dryer exhibits advantages such as saving of energy required for drying of a treated material, a reduction in drying time, minimizing of a water content of a product, complete removal of an organic material and a solvent from a treated material, elimination of oxidation of a treated material and firing thereof due to oxygen in air, low-temperature drying of a treated material, and the like, because it is constructed to dry a material while reducing a pressure in the rotary drum.

Thus, such a dryer is extensively applied to manufacturing of pharmaceuticals in which it is highly required to prevent a deterioration in quality of pharmaceuticals due to oxidation and contamination thereof due to inclusion of any impurity therein or adhesion of bacteria thereto or the like.

In manufacturing of pharmaceuticals, it is required to minimize or substantially prevent contact of a product with the hands or an ambient atmosphere during a manufacturing process. Unfortunately, the conventional vacuum rotary dryer described above needs manual operation in charging of a treated material or treated solids into the rotary drum and removal of the solids dried from the rotary drum, resulting in failing to prevent contact of the solids with the hands and an ambient atmosphere.

Also, the conventional vacuum rotary dryer fails in automation of a drying step because it requires manual operation in charging of a treated material or treated solids into the rotary drum and removal of the solids dried from the rotary drum. Thus, the drying step is deterrent to automation of manufacturing facilities.

An object of the present invention is to provide a vacuum rotary dryer which is capable of permitting all steps extending from charging of solids to a rotary drum to removal of the solids therefrom to be carried out without any manual operation.

DISCLOSURE OF INVENTION

In accordance with the present invention, a vacuum rotary dryer for drying particulate solids is provided. The vacuum rotary dryer includes a rotary drum arranged so as to be varied in inclination angle at which a central axis thereof acting as a center of rotation thereof is inclined with respect to a horizontal direction in a vertical plane, a drum inclination angle adjusting structure for adjusting the inclination angle of the central axis of the rotary drum, a drum rotating driver for driving the rotary drum to rotate it, a gas flow pipe arranged so as to airtightly extend through a central portion of one end of the rotary drum in an axial direction thereof into the rotary drum while permitting rotation of the rotary drum, a pressure reducing unit for sucking gas in the rotary drum to reduce a pressure in the rotary drum, a gas flow passage change-over structure for connecting the gas flow pipe to a piping connected to the pressure reducing unit and a gas space at an atmospheric pressure while carrying out change-over thereof, a solids feed and discharge pipe including a straight pipe section having one end inserted into the rotary drum from a side of the other end of the rotary drum in the axial direction thereof while permitting rotation of the rotary drum and a swing section arranged so as to extend from the one end of the straight pipe section positioned in the rotary drum toward a peripheral wall of the rotary drum and communicate with the straight pipe section, a feed and discharge pipe drive structure arranged so as to rotate the straight pipe section of the solids feed and discharge pipe to pivotally move the swing section in the rotary drum, a feed and discharge change-over structure for connecting the straight pipe section of the solids feed and discharge pipe to a piping connected to a feed source of solids to be dried and a piping connected to a solids suction and transport structure for transporting dried solids by suction while carrying out change-over thereof, and a drum heating structure for heating the rotary drum to dry solids in the rotary drum. The drum inclination angle adjusting structure varies the inclination angle of the central axis of the rotary drum. The swing section of the solids feed and discharge pipe is arranged so as to be pivotally movable between a final suction position at which a distal end of the swing section approaches a corner between an end wall of the rotary drum on a side of the other end of the rotary drum in the axial direction thereof and a lower portion of the rotary drum and a retreat position at which the swing section is retreated from the final suction position.

In operation of the vacuum rotary dryer in a normal manner, the gas flow passage change-over structure, feed and discharge change-over structure, feed and discharge pipe drive structure and drum inclination angle adjusting structure operate in the following way.

More particularly, the gas flow passage change-over structure connects the other end of the gas flow pipe to the piping connected to the pressure reducing unit when solids to be dried are fed to the rotary drum and when solids in the rotary drum are dried and connects the other end of the gas flow pipe to the gas space at an atmospheric pressure while carrying out change-over thereof when solids in the rotary drum are taken out of the rotary drum.

The feed and discharge change-over structure connects the other end of the straight pipe section of the solids feed and discharge pipe to the piping connected to the feed source of solids to be dried when solids to be dried are fed to the rotary drum, closes the other end of the straight pipe section when solids in the rotary drum are dried, and connects the other end of the straight pipe section to the piping connected to the solids suction and transport structure for transporting dried solids by suction when solids in the rotary drum are taken out of the rotary drum.

The feed and discharge pipe drive structure is arranged so as to position the swing section of the solids feed and discharge pipe at the retreat position when solids are fed to the rotary drum and pivotally moves the distal end of the swing section of the solids feed and discharge pipe while intruding the distal end into solids in the rotary drum when solids are taken out of the rotary drum.

The drum inclination angle adjusting structure varies the inclination angle of the central axis of the rotary drum so that the other end of the rotary drum is positioned above the one end thereof when solids are fed to the rotary drum and the other end of the rotary drum is positioned below the one end thereof when solids in the rotary drum are taken out of the rotary drum.

Such construction as described above reduces a pressure in the rotary drum while keeping the straight section of the solids feed and discharge pipe connected to the piping connected to the solids feed source and keeping the gas flow pipe connected to the piping connected to the pressure reducing unit, so that solids may be fed to the rotary drum from the solids feed source through the piping and solids feed and discharge pipe.

When the amount of solids in the rotary drum reaches a predetermined level; the other end of the straight pipe section of the solids feed and discharge pipe is closed, the rotary drum is rotated while keeping the gas flow pipe connected to the pressure reducing unit, and a reduction in pressure in the rotary drum by the pressure reducing unit and heating of the rotary drum by the drum heating structure are carried out, resulting in solids in the rotary drum being dried.

Such drying under a reduced pressure in the rotary drum permits a water content of solids to be substantially reduced even when the rotary drum is reduced in temperature, leading to energy savings.

Also, drying under a reduced pressure in the rotary drum prevents oxidation of solids to be dried and firing of the solids due to oxidation thereof. Also, it permits an organic solvent possibly contained in the solids to be fully removed therefrom.

When drying of solids in the rotary drum is completed, the straight section of the solids feed and discharge pipe is pivotally moved toward the final suction position and concurrently the solids suction and transport structure is operated while keeping the straight section of the solids feed and discharge pipe and the gas flow pipe respectively connected to the solids suction and transport structure and the gas space at an atmospheric pressure and keeping the inclination angle of the central axis of the rotary drum varied so as to position the other end of the rotary drum below the one end thereof, resulting in solids being transferred from the rotary drum to a product tank by suction. Such inclination of the rotary drum permits dried flowable crystal- or powder-like solids to be collected on a lowermost portion of the rotary drum and removed through the distal end of the straight section of the solids feed and discharge pipe by suction, so that substantially all solids in the rotary drum may be removed therefrom. Thus, the vacuum rotary dryer may be ready for the next drying procedure without requiring to remove solids from the rotary drum by manual operation.

As described above, the present invention carries out charging of solids into the rotary drum and removal of dried solids from the rotary drum without requiring any manual operation, to thereby permit automation of the whole drying treatment to be facilitated. The whole process extending from charging of solids to removal thereof takes place while keeping the solids from being contacted with an ambient atmosphere and without requiring any manual operation, to thereby prevent a deterioration in quality of solids, inclusion of any impurity in the solids and contamination thereof due to adhesion of bacterial thereto or the like.

In order to facilitate mounting of the solids feed and discharge pipe, a feed and discharge pipe support member is, preferably coupled to a central portion of the other end of the rotary drum in the axial direction thereof while permitting rotation of the rotary drum. In this instance, the solids feed and discharge pipe is preferably constructed so that the straight pipe section is arranged in a manner to rotatably extend through the feed and discharge pipe support member at a position deviated from the central axis of the rotary drum and has one end inserted into the rotary drum and the swing section is arranged so as to extend from the one end of the straight pipe section positioned in the rotary drum toward a peripheral wall of the rotary drum and communicate with the straight pipe section.

Such arrangement of the solids feed and discharge pipe wherein the straight pipe section extends through the feed and discharge pipe support member at the position deviated from the central axis of the rotary drum permits a gap of a large size to be defined between the distal end of the swing section and an inner surface of the rotary drum while keeping the swing section held at the retreat position, to thereby facilitate discharge of solids through the solids feed and discharge pipe during feed of solids through the solids feed and discharge pipe to the rotary drum. Also, when the solids feed and discharge pipe is kept at the final suction position, the solids feed and discharge pipe permits the distal end thereof to approach the inner surface of the lowermost portion of the rotary drum, so that substantially all solids may be recovered from the rotary drum.

Preferably the present invention further includes a control unit which controls the drum rotating driver, the feed and discharge change-over structure, the gas flow passage change-over structure, the pressure reducing unit, the solids suction and transport structure, the drum inclination angle adjusting structure, the feed and discharge pipe drive structure, and the drum heating structure so as to permit the whole process extending from the solid-liquid separation step to the solids dry and removal step to be automatically executed.

Thus, in a preferred embodiment of the present invention, the control unit is constructed so as to control the drum rotating driver, feed and discharge change-over structure, gas flow passage change-over structure, pressure reducing unit, solids suction and transport structure, drum inclination angle adjusting structure, feed and discharge pipe drive structure, and drum heating structure in such a manner that solids feed operation of reducing a pressure in the rotary drum to feed solids to be dried from the solids feed source to the rotary drum through the solids feed and discharge pipe while keeping the central axis of the rotary drum inclined so as to position the other end of the rotary drum above the one end thereof and keeping the other end of the straight pipe section of the solids feed and discharge pipe and the other end of the gas flow pipe respectively connected to the piping connected to the solids feed source and the piping connected to the pressure reducing unit; drying operation of closing the other end of the straight pipe section of the solids feed and discharge pipe to rotate the rotary drum while keeping the other end of the gas flow pipe connected to the pressure reducing unit and carrying out a reduction in pressure in the rotary drum by the pressure reducing unit, and heating of the rotary drum by the drum heating structure to dry solids in the rotary drum, when the solids feed operation is attained a predetermined number of times to permit the amount of solids in the rotary drum to reach a predetermined level; and suction and discharge operation of carrying out suction and discharge of solids in the rotary drum by the solids suction and transport structure while pivotally moving the swing section of the solids feed and discharge pipe toward the final suction position, while keeping the other end of the straight pipe section of the solid feed and discharge pipe and the other end of the gas flow pipe respectively connected to the piping connected to the solids suction and transport structure and the gas space at an atmospheric pressure and keeping the central axis of the rotary drum inclined so as to position the other end of the rotary drum below the one end thereof may be carried out.

BRIEF DESCRIPTION OF DRAWINGS

FIGS. 8A and 8B each show a modification of a solids feed and discharge pipe arranged in a vacuum rotary dryer according to the present invention, wherein FIG. 8A is a side elevation view showing the feed and discharge pipe of which a swing section is at a final suction position and FIG. 8B is a side elevation view showing the feed and discharge pipe of which the swing section is at a retreat position;

FIGS. 9A and 9B each show another modification of a solids feed and discharge pipe arranged in a vacuum rotary dryer according to the present invention, wherein FIG. 9A is a side elevation view showing the feed and discharge pipe of which a swing section is at a final suction position and FIG. 9B is a side elevation view showing the feed and discharge pipe of which the swing section is at a retreat position.

BEST MODES FOR CARRYING OUT INVENTION

Now, a vacuum rotary dryer according to the present invention will be described hereinafter with reference to a combination of the vacuum rotary dryer with a centrifugal filtering unit by way of example.

Figure 1:
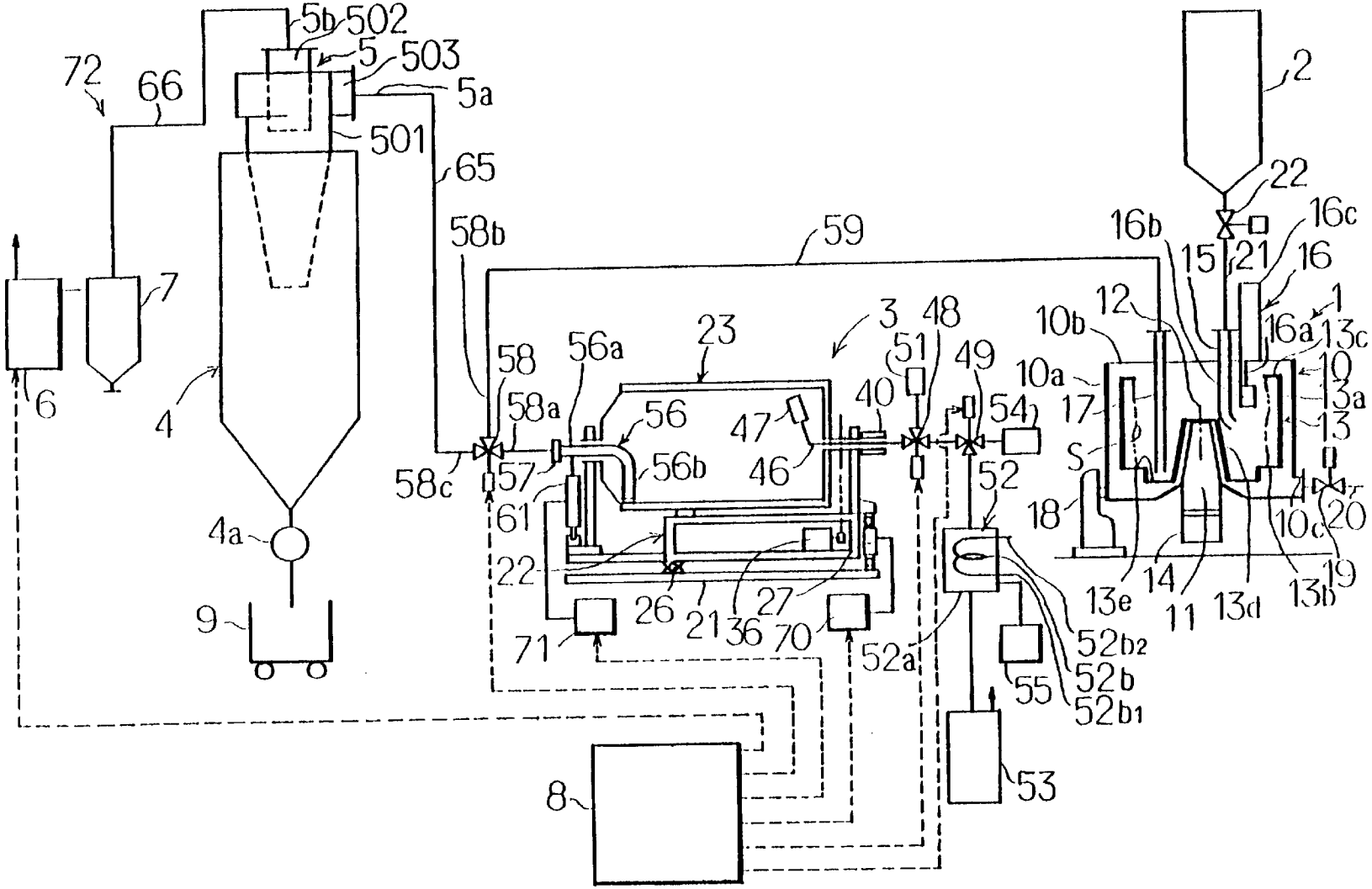
FIG. 1 is a schematic view generally showing a filtering and drying apparatus to which a vacuum rotary dryer according to the present invention is applied by way of example.

Referring first to FIG. 1, a filtering and drying apparatus constituted by a combination of a vacuum rotary dryer of the present invention with a centrifugal filtering unit is illustrated. In FIG. 1, reference numeral 1 designates a centrifugal filtering unit for carrying out solid-liquid separation or separating a stock solution into solids and liquid. Reference numeral 2 is a stock solution feed source for feeding the stock solution to the centrifugal filtering unit 1, 3 is a vacuum rotary dryer according to the present invention for drying solids obtained in the centrifugal filtering unit 1, 4 is a product tank for storing or collecting solids dried by the vacuum rotary dryer 3 therein, 5 is a cyclone separator mounted on an upper section of the product tank 4, 6 is a vacuum pump connected through a filter 7 to a discharge port 5*a* of the cyclone separator 5, and 8 is a control unit for controlling operation of each of sections of the vacuum rotary dryer in a predetermined sequence by means of a computer. The product tank 4 is mounted on a lower portion thereof with a rotary valve 4*a*. Reference numeral 9 designates a transport means for transporting solids discharged through the rotary valve 4*a* from the product tank 4 to the next station.

The centrifugal filtering unit 1 includes a closed casing 10, a basket 13 arranged in the casing 10 and mounted on a revolving shaft 12 rotatably supported on the casing 10 through a bearing structure 11, a basket rotating driver 14 for driving the basket 13 to rotate it, a stock solution feed pipe 15 for feeding a stock solution into the basket 13, a solids scraper 16 for scraping solids deposited on an inner periphery of the basket 13, and a solids discharge pipe 17 for discharging solids scraped by the solids scraper 16 and dropped onto a bottom of the basket 13.

The casing 10 includes a casing body 10a including a peripheral wall formed into a cylindrical shape and a cover 10*b* for closing an opening formed at an upper end of the casing body 10*a*, wherein the casing body 11*a* is supported on a support base through a support structure 18 including a shock absorber. The peripheral wall of the casing 10 is provided at a lower portion thereof with a liquid discharge port 10*c* for discharging liquid separated from the stock solution due to rotation of the basket 13. The liquid discharge port 10*c* has a liquid discharge pipe 20 connected thereto through a valve 19.

The basket 13 includes a cylindrical peripheral wall 13*a*, a bottom wall 13*b* for closing one of both ends of the peripheral wall 13*a* defined in an axial direction thereof and an annular end plate 13*c* arranged so as to radially inwardly extend from the other end of the peripheral wall 13*a*. The bottom wall 13*b* is formed at a central portion thereof with a boss 13*d*, which is mounted thereon with the revolving shaft 12, which is then rotatably supported on the casing 10 through the bearing structure 11. The revolving shaft 12 is connected at a lower end thereof to an output shaft of the basket rotating driver 14, so that the basket 13 is driven for rotation by the rotating driver 14. The basket driving driver 14 may be constituted by a motor controlled by an inverter, a hydraulic motor or the like. The bottom wall 13*b* of the basket 13 is formed with an annular groove 13*e* in a manner to surround a base of the boss 13*d*. The peripheral wall 13*a* of the basket 13 is formed with a plurality of through-holes and provided on an inner periphery thereof with a filter. The filter may be made of a fabric or constituted by a perforated plate arranged on an inner periphery of a wire net formed into a cylindrical shape.

The stock solution feed pipe 15 is arranged so as to extend through the cover 10*b* of the casing 10 into the basket 13. The stock solution feed pipe 15 is connected at an end thereof positioned outside the casing through a piping 21 and a solenoid valve 22 to a stock solution outlet of the stock solution feed source 2. The stock solution feed source 2 includes a tank, a reactor or the like in which a stock solution (slurry) is received.

The solid scraper 16 includes scraping blades 16*b* mounted on a shaft 16*a* arranged so as to extend in the axial direction of the basket 13 and inserted into the basket 13 and a drive mechanism 16*c* for driving the shaft 16*a* having the scraping blades mounted thereon so that movement of the scraping blades 16*b* in the axial direction of the basket and pivotal movement thereof about the shaft 16*a* may be carried out using a hydraulic cylinder or the like as a drive source. A solid scraper of such type is known in the art.

The solids discharge pipe 17 is arranged so as to extend through the cover 10*b* of the casing 10 into the basket 13. Also, the solids discharge pipe 17 is arranged in a manner to be movable in a vertical direction, so that a lower end thereof is inserted into the groove 13*e* when solids are discharged from the basket 13.

In order that the centrifugal filtering unit 1 carries out solid-liquid separation of a stock solution, the basket rotating driver 14 is activated to rotate the basket 13 and the solenoid valve 22 is rendered open to feed the stock solution from the stock solution feed source 2 through the piping 21 and stock solution feed pipe 15 to the basket 13. This causes the stock solution fed to the basket 13 being rotated to form a liquid layer on an inner periphery of the peripheral wall 13*b* of the basket. The stock solution is separated into solids and liquid by centrifugal force occurring due to rotation of the basket, wherein the liquid is discharged to a space between the basket 13 and the casing 10 through the filter arranged on the inner periphery of the basket and the through-holes formed via the peripheral wall 13*a* of the basket. This permits the solids to be deposited in the form of a layer on the inner periphery of the basket. When the solids being deposited are formed into a predetermined thickness, the stock solution feed step is terminated and a liquid removal step is started for removing any liquid from the solids while keeping a rotational speed of the basket at a predetermined level. After the liquid removal step is completed, a cleaning step is carried out for feeding a cleaning fluid to the basket to clean the solids. Then, a dehydration step takes place, followed by braking of the basket rotating driver to decelerate the basket.

The above-described stock solution feed step, liquid removal step, cleaning step and dehydration step cooperate with each other to constitute a solid-liquid separation step. After the solid-liquid separation step is completed, the scraping blades 16*b* arranged on a side of the upper end of the basket are advanced or intruded into solids formed on the inner periphery of the basket to scrape the solids therefrom while keeping the basket rotated at a low rotational speed and suction force applied to the solids discharge pipe 17. The scraped solids are then dropped onto a bottom of the basket. The solids dropped are then outwardly discharged through the solids discharge pipe 17 by suction. The scraping blades 16*b* are downwardly moved toward the bottom of the basket with the progress of solids scraping operation. When the scraping blades 16*b* are lowered to the bottom of the basket, the blades are pivotally moved to drop the solids remaining on the bottom of the basket into the groove 13*e*.

The centrifugal filtering unit 11 as described above, is so constructed that the solids scraped from the inner periphery of the basket 13 are collected in the groove 13*e* formed on the bottom of the basket and then outwardly discharged through the solids discharge pipe 17 by suction. Such construction permits substantially all solids formed in the basket 13 to be taken out of the basket while keeping the basket 13 placed in the closed casing 10, resulting in recovery of the solids being accomplished at increased efficiency. A centrifugal filtering unit of such a type as described above is fully described in Japanese Patent Publications Nos. 28553/1985 and 44982/1987.

Figure 2:
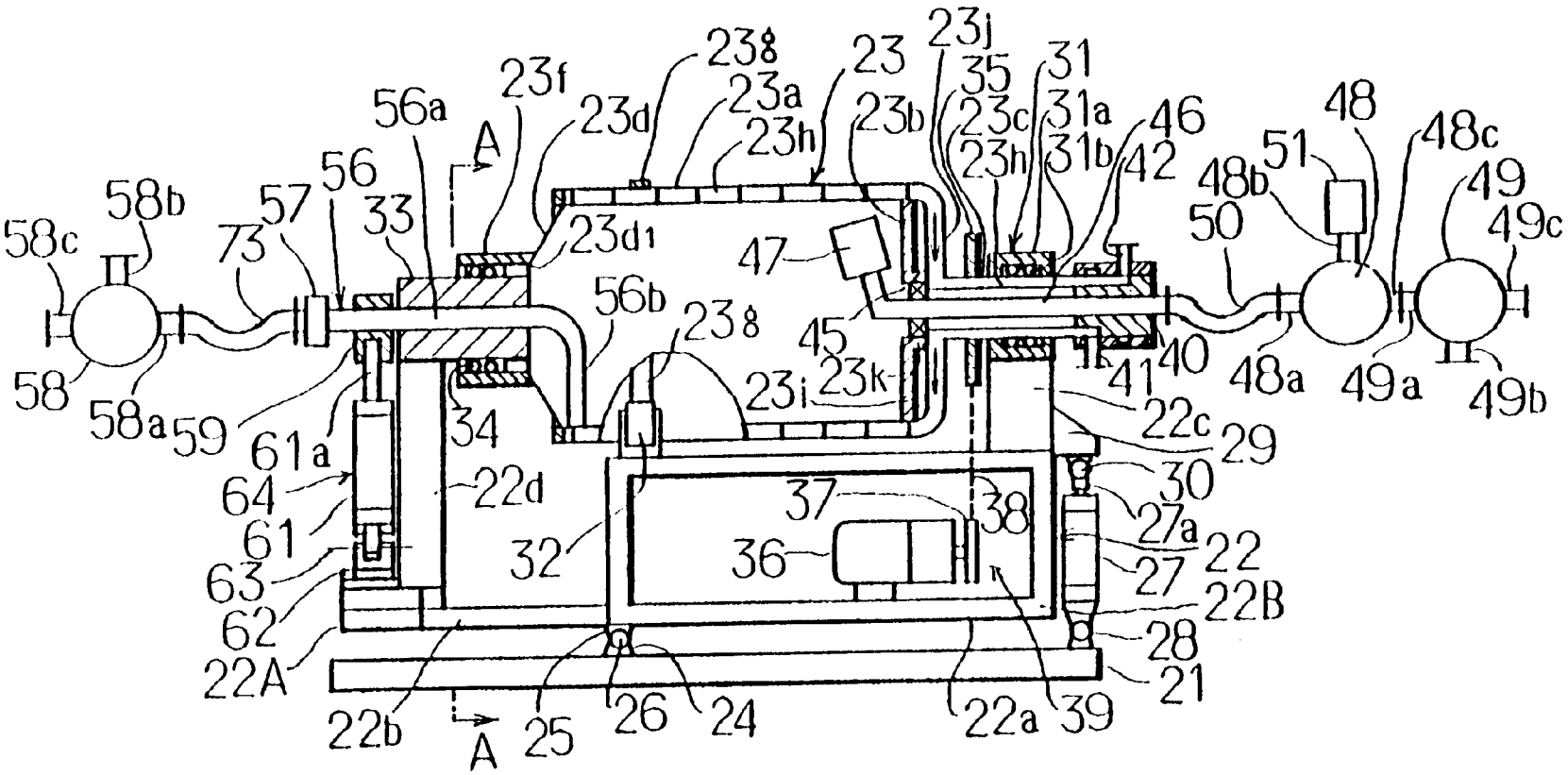
FIG. 2 is a sectional view showing an essential part of a vacuum rotary dryer according to the present invention.
Figure 3:
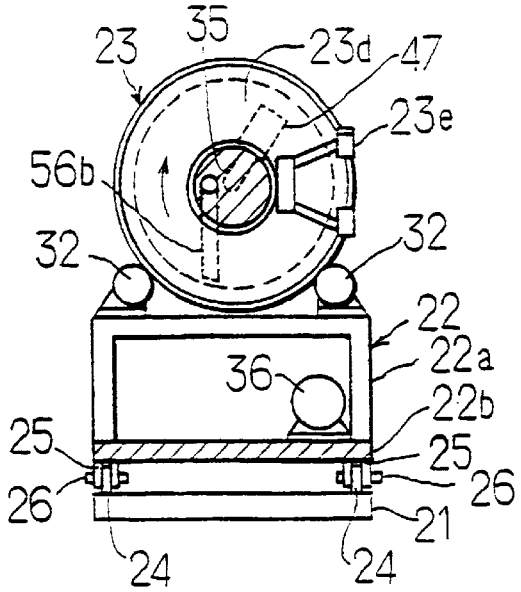
FIG. 3 is a sectional view taken along line A—A of FIG. 2.

The vacuum rotary dryer 3 according to the present invention is constructed in such a manner as shown in FIGS. 2 and 3. More particularly in FIGS. 2 and 3, reference numeral 21 designates a support base and 22 is a support frame supported on the support base 21 so as to be pivotally movable or swingable within a predetermined angle, and 23 is a rotary drum rotatably supported on the support frame 22.

In the illustrated embodiment, the support base 21 is fixedly mounted on both ends thereof defined in a width direction thereof with brackets 24, 24 while keeping them deviated to a front end thereof in a longitudinal direction thereof (or a left-hand end thereof in FIG. 2) rather than a central portion. Also, the support frame 22 is mounted on a lower portion thereof with brackets 25, 25, which are connected to the brackets 24, 24, through pins 26, 26 arranged so as to coaxially extend in a horizontal direction thereof, respectively.

The support frame 22 includes a frame body 22*a* formed into a substantially rectangular parallelopiped frame-like shape and an extension 22*b* arranged on the fame body 22*a* so as to forwardly extend from a lower portion of a front end of the frame body 22*a*. The frame body 22*a* is fixedly mounted on an upper portion of a rear end thereof with a strut 22*c* and the extension 22*b* is fixedly mounted at a portion thereof in proximity to a distal end thereof with a strut 22*d*. The struts 22*c* and 22*d* are arranged so as to face each other in a longitudinal direction of the support frame 22.

The support frame 22 is arranged so as to be pivotally movable about the pins 26 within an angular range of 5 to 10 degrees between a first position at which a front end 22A of the support frame 22 or a distal end of the extension 22*b* is abutted against the support base 21 and a second position at which a rear end 22B thereof is abutted against the support base 21.

In order to permit such pivotal movement of the support frame 22, the support base 21 has a hydraulic cylinder 27 to be pivotally supported at a rear end thereof (or a right-hand end thereof in FIG. 2) through a pin 28. The hydraulic cylinder 27 has a piston rod 27*a* coupled through a pin 30 to a bracket 29 fixed on the strut 22*c*.

In order to control the hydraulic cylinder 27, a controller 70 (FIG. 1) is arranged which includes a direction change-over valve for changing over a direction in which hydraulic oil fed to the hydraulic cylinder 27 flows and a flow control valve for adjusting a flow rate of the hydraulic oil.

The support frame 22 is pivotally moved about the pins 26 to the first position at which the front end 22A thereof (or the distal end of the extension 22*b*) is abutted against the support base 21 when the piston rod 27*a* of the hydraulic cylinder 27 is extended and to the second position at which the rear end 22B thereof is abutted against the support base 21 when the piston rod 2 is retreated.

The strut 22*c* is fixedly mounted on an upper end thereof with a bearing structure 31 for rotatably supporting one end of the rotary drum 23. The bearing structure 31 includes a bearing casing 31*a* of a cylindrical shape and a ball bearing or a roller bearing 31*b* arranged in the bearing casing 31*a*.

The rotary drum 23 includes a drum body 23*a* formed into a cylindrical shape, a bottom wall 23*b* arranged so as to close one of both ends of the drum body 23*a* defined in an axial direction of the drum body 23*a*, a hollow shaft 23*c* arranged at a central portion of the bottom wall 23*b* in a manner to be coaxial with the drum body 23*a*, and a cover 23*d* arranged so as to close the other end of the drum body 23*a*. The hollow shaft 23*c* is rotatably supported by the bearing structure 31. The cover 23*d* is openably mounted on the drum body 23*a* by means of a hinge 23*e*, so that it may be open when an interior of the rotary drum 23 is to be cleaned. The cover 23*d* is formed at a central portion thereof with a hole 23*e*1, which has a boss 23*f* of a cylindrical shape welded to a peripheral edge thereof in a manner to be coaxial with the drum body 23*a*.

The rotary drum 23 is formed into a volume sufficient to treat therein solids obtained through a solid-liquid separation treatment carried out several times by the centrifugal filtering unit 1. The amount (volume) of solids dried at one time in the vacuum rotary dryer is preferably limited to a level about one quarter as large as an internal volume of the rotary drum 23. Thus, when the vacuum rotary dryer is combined with the centrifugal filtering unit, a volume of the rotary drum 23 is preferably set so that about one quarter as large as the internal volume of the rotary drum 23 is equal to a volume of the solids obtained by the solid-liquid separation treatment carried out several times in the centrifugal filtering unit 1 or, for example, the solid-liquid separation treatment for one lot.

The rotary drum 23 is securely fitted on an outer peripheral portion thereof near the other end thereof defined in the axial direction thereof with a drum support ring 23*g*. The frame body 22*a* of the support frame 22 is mounted on an upper portion thereof near the front end thereof with a pair of support rollers 32, 32 in a manner to be spaced from each other in a width direction of the support frame. The drum support ring 23*g* is arranged on the support rollers, so that the other end of the rotary drum 23 in the axial direction thereof is rotatably supported thereon.

In the illustrated embodiment, the hydraulic cylinder 27 and controller 70 cooperate with each other to constitute a drum inclination angle adjusting structure for adjusting inclination of the support frame 22 to vary an inclination angle of the central axis of the rotary drum 23.

Into the boss 23*f* mounted on the cover 23*d* of the rotary drum 23 is inserted a column-like feed and discharge pipe support member 23 having a central axis aligned with that of the rotary drum. Between the feed and discharge pipe support member 33 and the boss 23*f* is arranged a bearing 34 of an air-tightness holding structure. The feed and discharge pipe support member 33 is fixed on the upper end of the strut 22*d*. More specifically, the feed and discharge pipe support member 33 is arranged so as to be coaxial with the rotary drum 23 and coupled to a central portion of the other end of the rotary drum in the axial direction thereof so as to permit rotation of the rotary drum.

In the illustrated embodiment, the peripheral wall of the drum body 23*a* of the rotary drum 23 is constructed into a double structure, to thereby constitute a jacket. A space in the jacket is suitably partitioned by means of a partition wall, to thereby define a heated-fluid flow passage 23*h* which extends via an outer periphery of the rotary drum body 23*a* from one end thereof to the other end thereof and returns to the one end thereof again. The heated-fluid flow passage 23*h* has an inlet and an outlet to which a heated-fluid lead-in pipe 23*i* and a heated-fluid lead-out pipe 23*j* are connected at one end thereof, respectively. Also, the heated-fluid lead-in pipe 23*i* and heated-fluid lead-out pipe 23*i* are connected at the other end thereof through separate flow passages arranged in the hollow shaft 23*c* and passages arranged in a rotary joint 40 connected to an end of the hollow shaft 23*c* opposite to the drum body to a heated-fluid inlet 41 of the rotary joint 40 and a heated-fluid outlet 42 thereof, respectively.

The rotary joint 40 functions to carry out transfer of heated fluid between the heated-fluid outlet 41 and the heated-fluid lead-in pipe 23*i* and that between the heated-fluid lead-out pipe 23*i* and the heated-fluid outlet 42 while permitting rotation of the hollow shaft 23*c*. The rotary joint 40 is fixed with respect to the support frame 22 using any suitable means. The heated-fluid inlet 41 of the rotary joint 40 is connected through a solenoid valve (not shown) and a piping (not shown) to a boiler for feeding hot water and the heated-fluid outlet 42 is connected through a piping (not shown) to a water storage tank for feeding water to the boiler. The solenoid valve for controlling hot water fed to the heated-fluid inlet 41 is controlled by the control unit 8.

Such a structure in which the hot water inlet and hot water outlet are connected through the rotary joint to the heated-fluid flow passage formed on the outer periphery of the rotary drum may be constructed in substantially the same manner as employed in a conventional vacuum rotary dryer. The rotary joint 40, the heated-fluid flow passage 23*h* formed on the outer periphery of the rotary drum 23 and the boiler (not shown) for feeding hot water to the heated-fluid flow passage cooperate with each other to constitute a drum heating structure for heating the rotary drum 23.

The hollow shaft 23*c* is mounted thereon with a pulley 35 and a belt 38 is arranged so as to extend between the pulley 35 and a pulley 37 mounted on an output shaft of a motor 36 equipped with a speed reducer and arranged on the frame body 22*a* of the support frame 22. In the illustrated embodiment, the motor 36, pulleys 35 and 37, and belt 38 cooperate with each other to provide a drum rotating driver 39.

The bottom wall 23*b* of the rotary drum 23 is provided on a central portion thereof with a boss 23*k*, which is mounted on an inside thereof with a bearing 45. Reference numeral 46 designates a gas flow pipe arranged so as to extend through a hole formed through a center of the rotary joint 40 in an axial direction thereof, the hollow shaft 23*c* arranged on the one side of the rotary drum 23 and an inner ring of the bearing 45.

The gas flow passage 46 is formed at a portion thereof extending through the hole of the axial center of the rotary joint 40, the hollow shaft 23*c* and the inner ring of the bearing 45 into a straight pipe section extending coaxially with the hollow shaft 23*c*. The straight pipe section is fixed on the support frame 22 using any suitable means. Between the straight pipe section of the gas flow pipe 46 and the bearing 45 and between the straight pipe section and the hole of the axial center of the rotary joint 40 are arranged seal means for maintaining the rotary drum airtight, respectively.

The gas flow pipe 46 is obliquely upwardly bent at one end thereof positioned in the rotary drum. The thus-bent end of the gas flow pipe 46 is mounted thereon with a filter 47 for preventing passage of solids. The gas flow pipe 46 is connected at the other end thereof through a gas flow passage change-over structure constituted of solenoid valves 48 and 49 to a gas space at an atmospheric pressure and a pressure reducing unit. The solenoid valve 48 includes first, second and third ports 48*a*, 48*b* and 48*c* and connects the first port 48*a* to the second port 48*b* and third port 48*c* while changing over them, depending on a control signal fed from the control unit 8 thereto. The solenoid valve 48 is connected at the first port 48*a* thereof through a flexible relay pipe 50 to the other end of the gas flow passage 46 and is open at the second port 48*b* thereof to the atmospheric space through an air filter 51.

The solenoid valve 49 likewise includes first, second and third ports 49*a*, 49*b* and 49*c* and connects the first port 49*a* to the second port 49*b* and third port 49*c* while changing over them, depending on a control signal fed thereto from the control unit 8. The solenoid valve 49 is connected at the first port 49*a* thereof to the third port 48*c* of the solenoid valve 48 and at the second port 49*b* thereof through a condenser 52 to a pressure reducing unit 53 as shown in FIG. 1. Also, the solenoid valve 49 is connected at the third port 49*c* thereof to a compressed air feed source 54. The solenoid valves 48 and 49 are supported by any suitable support means arranged separately from the support frame 22.

The condenser 52 shown in FIG. 1 functions to remove liquid contained in air in the rotary drum. For this purpose, the condenser 52 includes a vessel 52*a* connected through a piping to the second port 49*b* of the solenoid valve 49 and a gas suction port of the pressure reducing unit 53, as well as a cooling pipe 52*b* arranged in the vessel 52*a*. The cooling pipe 52*b* includes an inlet 52*b*1 connected to a cooling water tank (not shown) and an outlet 52*b*2 connected through a cooler (not shown) to the cooling water tank, so that cooling water may be circulated through a path extending from the cooling water tank through the cooling water pipe 52*b* and cooler to the cooling water tank, resulting in the cooling pipe 52*b* being cooled. The vessel 52*a* of the condenser also has a tank 55 connected thereto for collecting liquid produced in the vessel 52*a*.

The pressure reducing unit 53 acts to evacuate gas in the drum 23 by suction to reduce a pressure in the rotary drum. In the illustrated embodiment, the pressure reducing unit is constituted of a vacuum pump.

Figure 5A:
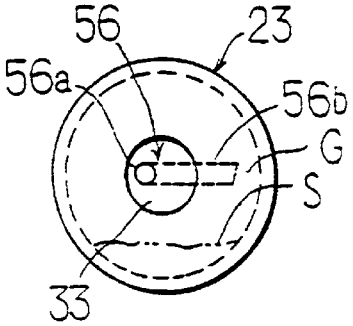
FIGS. 5A and 5B are a side elevation view and a front elevation view each schematically showing an essential part of a vacuum rotary dryer according to the present invention together with a manner of operation of the dryer, respectively.

The rotary drum 23 is mounted on the other end thereof defined in the axial direction thereof with a solids feed and discharge pipe 56 in a manner to extend through the feed and discharge support member 33. In the illustrated embodiment, the solids feed and discharge pipe 56 is formed into a substantially L-shape and includes a straight pipe section 56*a* arranged so as to rotatably extend through the feed and discharge support member 33 at a position horizontally deviated by 5 to 10 cm from a central axis of the rotary drum 23 and a swing section 56*b* arranged so as to extend from an end of the straight pipe section positioned in the rotary drum 23 to the peripheral wall of the rotary drum. The straight pipe section 56*a* is connected at the other end thereof to a solenoid valve 58 through a rotary joint 57 and a flexible relay pipe 73. The swing section 56 of the solids feed and discharge pipe 56, as shown, in FIG. 3, is formed at a distal end thereof with an opening and arranged so that the opening at the distal end thereof may be pivotally moved between a final suction position at which it is placed in proximity to an inner surface of the peripheral wall of the rotary drum and a retreat position at which it is retreated from the final suction position. The pivotal movement is carried out at a corner defined between a lower portion of the peripheral wall of the rotary drum 23 and the end wall (or cover 23*d* in the illustrated embodiment) of the rotary drum on a side of the other end thereof in the axial direction thereof, as shown in FIG. 3. The retreat position of the swing section 56*b* is defined, for example, at a position displaced by 90 degrees from the final suction position as shown in FIG. 5A. In the illustrated embodiment, the straight pipe section 56*a* of the solids feed and discharge pipe 56 is arranged at a position horizontally deviated by 5 to 10 cm from the central axis of the rotary drum 23, so that when the swing section 56*b* is at the retreat position shown in FIG. 5A, a gap G of a size as large as 5 to 10 cm may be defined between a distal end of the swing section 56*b* and the inner surface of the rotary drum 23.

The straight pipe section 56*a* is mounted at a portion thereof in proximity to the other end thereof with a lever 59, which is connected to a piston rod 61a of a hydraulic cylinder 61 through a pin. The hydraulic cylinder 61 is pivotally connected through a pin 63 to a support fitment 62 mounted on a distal end of the extension 22*b* of the support frame 22.

For the purpose of controlling the hydraulic cylinder 61, a controller 71 (FIG. 1) is arranged which includes a direction change-over valve for changing over a direction of flowing of hydraulic oil fed to the hydraulic cylinder 61 and a flow control valve for adjusting or controlling a flow rate of the hydraulic oil. The hydraulic cylinder 61 and controller 71 cooperate with each other to provide a feed and discharge pipe drive structure for rotating the straight pipe section 56*a* of the solids feed and discharge pipe 56 to pivotally move the swing section 56*b* in the rotary drum.

The solenoid-valve 58 includes first, second and third ports 58*a*, 58*b* and 58*c* and carries out change-over operation of connecting the first port 58*a* to the second port 58*b* and third port 58*c* while changing over them and operation of closing the other end of the straight pipe section 56*a* of the solids feed and discharge pipe 56. The solenoid valve 58 is connected at the first port 58*a* thereof to the other end of the straight pipe section 56*a* of the solids feed and discharge pipe 56 through the flexible relay pipe 73 and rotary joint 57. Also, the solenoid valve 58 is connected at the second port 58*b* thereof through the piping 59 shown in FIG. 1 to the solids discharge pipe 17 of the centrifugal filtering unit 1 and at the third port 58*c* thereof through a piping 65 to a mixed fluid inlet 5*a* of the cyclone separator 5.

Figure 4:
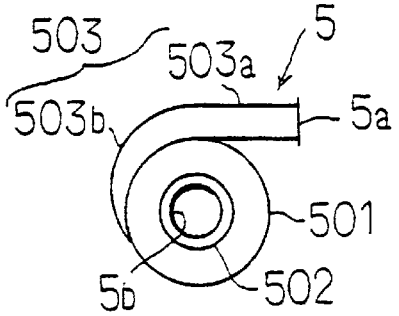
FIG. 4 is a plan view showing a cyclone separator incorporated in the apparatus shown in FIG. 1.

The cyclone separator 5 may be constructed in such a manner as that conventionally widely used for separating mixed fluid of gas and particulate (powdery or crystalline) solids into the gas and solids. Thus, as shown in FIG. 4, it includes an outer cylinder 501 closed at an upper end thereof and provided at a lower portion thereof with a conical section, of which a lower end is open in the product tank 5, an inner cylinder 502 arranged in a central section of the outer cylinder 501 in a manner to be coaxial with the outer cylinder 501 and having an upper end projected above an upper end of the outer cylinder 501, and a mixed fluid inlet duct 503 arranged along a part of an outer periphery of the outer cylinder 501. The mixed fluid inlet duct 503 includes a straight pipe section 503*a* arranged so as to extend in a tangential direction of the outer cylinder 501 and having one end acting as the mixed fluid inlet 5*a*, as well as a curved section 503*b* connected at one end thereof to the other end of the straight pipe section 503*a* and arranged so as to partially surround the outer periphery of the outer cylinder 501, to thereby permit the other end thereof to communicate with an interior of the outer cylinder 501. The curved section 503*b* is arranged so as to extend along a cycloid curve converging on the outer periphery of the outer cylinder 501. The inner cylinder 502 is so formed that a lower end thereof is open to the product tank 4 and an upper end thereof is connected through a piping 66 to the filter 7 so as to act as an outlet.

The cyclone separator 5 thus constructed, when gas in the inner cylinder 502 is sucked through the discharge hole 5*b*, acts to suck mixed fluid of particulate solids and gas (normally air) from the mixed fluid inlet 5*a* through the inlet duct 503 into the outer cylinder 501. The mixed fluid sucked into the outer cylinder forms swirling flow in a space between the outer cylinder 501 and the inner cylinder 502, so that solids and gas contained in the mixed fluid may be separated from each other due to centrifugal force generated with rotation of the swirling flow. The particulate solids separated are caused to drop along an inner surface of the outer cylinder 501 into the product tank 4, whereas the gas is discharged through the inner cylinder 502. The filter 7 functions to prevent particulate solids which is discharged out of the outlet 5*b* without being separated by the cyclone separator from flowing into the vacuum pump 6.

In the illustrated embodiment, the cyclone separator 5, filter 7 and vacuum pump 6 cooperate with each other to provide a solids suction and transport structure 72 for transporting solids in the rotary drum 23 into the product tank 4 by suction.

Also, the solenoid valve 58 provides a feed and discharge change-over structure for carrying out operation of changing over the other end of the straight pipe section 56*a* of the solids feed and discharge pipe to the piping 59 connected to the solids discharge pipe 17 of the centrifugal filtering unit 1 or the piping 65 connected to the solids suction and transport structure while carrying out change-over thereof, as well as operation of closing the other end of the straight pipe section 56*a* of the solids feed and discharge pipe 56.

In the apparatus shown in FIG. 1, the direction change-over valve and flow control valve respectively provided at the controllers 70 and 71 for controlling the hydraulic cylinders 27 and 61 are electrically controlled. To this end, control signals for controlling the valves are fed from the control unit 8 to the controllers 70 and 71.

In the illustrated embodiment, the vacuum rotary dryer 3 is constituted of the support-frame 22 arranged so as to be pivotally movable about the horizontally extending pivotal central shaft (or pin 26); the rotary drum 23 rotatably supported on the support frame 22 and arranged so as to be varied in inclination angle at which the central axis thereof acting as a center of rotation is inclined with respect to a horizontal direction in a vertical plane with pivotal movement of the support frame; the drum inclination angle adjusting structure for pivotally moving the support frame 22 so as to vary the inclination angle of the central axis of the rotary drum 23 while using the hydraulic cylinder 27 as a drive source therefor; the drum rotating driver for driving the rotary drum 23 to rotate it while using the motor 36 as a drive source therefor; the gas flow pipe 46 arranged so as to airtightly extend through the central portion of one end of the rotary drum in the axial direction thereof into said rotary drum while permitting rotation of the rotary drum; the filter 47 for preventing passage of solids which is mounted on one end of the gas flow pipe 46 positioned in the rotary drum 23; the pressure reducing unit 53 for sucking gas in the rotary drum 23 through the gas flow pipe 46 to reduce a pressure in the rotary drum; the gas flow passage change-over structure (solenoid valves 48, 49) for connecting the other end of the gas flow pipe 46 to the pressure reducing unit 53 or the gas space at an atmospheric pressure while carrying our change-over thereof; the feed and discharge pipe support member 33 arranged coaxially with the rotary drum 23 and coupled to the central portion of the other end of the rotary drum in the axial direction thereof while permitting rotation of the rotary drum; the solids feed and discharge pipe 56 including the straight pipe section 56*a* arranged so as to rotatably extend through the feed and discharge support member 33 at a position deviated from the central axis of the rotary drum 23 and the swing section 56*b* arranged so as to extend from one end of the straight pipe section positioned in the rotary drum toward the peripheral wall of the rotary drum and communicate with the straight pipe section 56*a*; the feed and discharge pipe drive structure arranged so as to rotate the straight pipe section 56*a* of the solids feed and discharge pipe 56 to pivotally move the swing section 56*b* in the rotary drum while using the hydraulic cylinder 61 as a drive source therefor; the solids suction and transport structure 72 for sucking solids in the rotary drum and transport them to the product tank 4; the feed and discharge change-over structure (solenoid valve 58) for carrying out operation of changing over the other end of the straight pipe section 56*a* of the solids feed and discharge pipe 56 to the piping 59 connected to the solids discharge pipe 17 of the centrifugal filtering unit 1 or the piping 65 connected to the solids suction and transport structure 72 while carrying out change-over thereof and operation of closing the other end of the straight pipe section of the solids feed and discharge pipe; the drum heating structure including the heated-fluid flow passage 23*h* formed on the outer periphery of the rotary drum 23 and the rotary joint 40 connected to the heated-fluid flow passage 23*h* while permitting rotation of the rotary drum, to thereby connect the heated-fluid flow passage 23*h* to the heated-fluid feed source; and the control unit 8 for controlling the drum rotating driver 39, feed and discharge change-over structure, gas flow passage change-over structure, pressure reducing unit 53, solids suction and transport structure 72, drum inclination angle adjusting structure, feed and discharge pipe drive structure, and drum heating structure.

The rotary drum 23 is formed into a volume sufficient to receive therein solids formed by a solid-liquid separation treatment carried out several times by the centrifugal filtering unit 1.

The control unit 8 is constructed so as to control the drum rotating driver 36, feed and discharge change-over structure, gas flow passage change-over structure, pressure reducing unit 53, solids suction and transport structure 72, drum inclination angle adjusting structure, feed and discharge pipe drive structure, and drum heating structure so that solids feed operation of reducing a pressure in the rotary drum 23 to suck solids in the basket 13 of the centrifugal centering unit through the solids discharge pipe 17, feed and discharge change-over structure and solids feed and discharge pipe 56, to thereby feed the solids to the rotary drum 23 while keeping the central axis of the rotary drum inclined so as to position the other end of the rotary drum in the axial direction thereof above the one end thereof and keeping the other end of the straight pipe section 56*a* of the solids feed and discharge pipe 56 and the other end of the gas flow pipe 46 respectively connected to the piping 59 connected to the solids discharge pipe of the centrifugal filtering unit and the piping connected to the pressure reducing unit 5, when solids are discharged from the basket 13 of the centrifugal filtering unit 1; drying operation of closing the other end of the straight pipe section 56*a* of the solids feed and discharge pipe 56 to rotate the rotary drum while keeping the other end of the gas flow pipe 46 connected to the pressure reducing unit 53 and carrying out a reduction in pressure in the rotary drum 23 by the pressure reducing unit and heating of the rotary drum 23 by the drum heating structure to dry solids in the rotary drum, when the solids feed operation is attained a predetermined number of times to permit the amount of solids in the rotary drum 23 to reach a predetermined level; and suction and discharge operation of carrying out suction and discharge of solids in the rotary drum 23 by the solids suction and transport structure 72 while pivotally moving the swing section 56*b* of the solids feed and discharge pipe 56 toward the final suction position, while keeping the other end 56*a* of the straight pipe section of the solid feed and discharge pipe 56 and the other end of the gas flow pipe 46 respectively connected to the solids suction and transport structure 72 and the gas space at an atmospheric pressure and keeping the central axis of the rotary drum inclined so as to position the other end of the rotary drum in the axial direction thereof below the one end thereof may be carried out.

In the apparatus shown in FIG. 1, the solid-liquid separation treatment of separating a stock solution into solids and liquid and the cleaning treatment of cleaning the solids separated are carried out by the centrifugal filtering unit 1.

The solid-liquid separation treatment including the stock solution feed step and liquid removal step is carried out while keeping the solids discharge pipe 17 raised above the position shown in FIG. 2 and keeping the scraping blades 16*b* radially inwardly retreated from a position corresponding to the inner periphery of the end plate 13*c* of the basket 13.

In the stock solution feed step, first the basket rotating driver 14 is driven to rotate the basket 13 at a rotational speed suitable for feeding of the solution and then the solenoid valve 22 is rendered open to feed the stock solution from the stock solution feed source 2 through the stock solution feed pipe 15 to the basket 13. The stock solution fed to the basket forms a liquid layer on the inner periphery of the basket. When, in the course of stock solution feed, when an output of a level detector (not shown) indicates that a level of the stock solution in the basket reaches a limit level, feed of the stock solution is interrupted. Centrifugal force occurring with rotation of the basket causes liquid contained in the stock solution to be outwardly discharged from the basket through the filter arranged on the inner surface of the peripheral wall 13*a* of the basket and the through-holes of the peripheral wall of the basket, so that solids (crystals) contained in the stock solution may be deposited on the inner surface of the peripheral wall 13*a* of basket 13. The liquid discharged outwardly of the basket flows down in the casing 10 and is removed from the liquid outlet 10*c* through the valve 19 and liquid discharge pipe 20.

Then, when it is detected that the stock solution is lowered to a predetermined level with progress of liquid removal, feed of the stock solution is restarted. Thereafter, when it is detected that the stock solution is raised to the limit level, feed of the stock solution is interrupted again.

Repeating of the operation described above causes a layer of the solids formed on the inner surface of the basket to be increased in thickness, resulting in time required for removal of the liquid being increased with an increase in thickness of the solids. When the solids layer is substantially increased in thickness to a degree sufficient to cause a failure in detection of lowering of a level of the stock solution within a predetermined time range, feed of the stock solution to the basket is interrupted, resulting in the stock solution feed step being terminated. After termination of the stock solution feed step, the basket is increased in rotational speed to a level required for the liquid removal step. The rotational speed is kept at the level for a period of time for liquid removal experimentally determined, resulting in the liquid removal being carried out.

After the liquid removal time elapses, a cleaning step of cleaning solids or crystals in the basket takes place. The cleaning step is carried out by feeding cleaning fluid to the basket through a cleaning fluid feed pipe (not shown) while rotating the basket at a rotational speed suitable for the cleaning, to thereby clean the crystals with the cleaning fluid. After a predetermined period of time elapses, the basket is increased in rotational speed to a level required for removal of the cleaning fluid, resulting in the cleaning fluid contained in the crystals being removed therefrom.

After the cleaning step is completed, a crystal scraping step of scraping the crystals formed in the basket 13 and a discharge step of discharging the crystals scraped-take place. The crystal scraping step is carried out by pivotally moving the scraping blades 16*b* of the solids scraper 16 toward the peripheral wall 13*a* of the basket 13, resulting in the scraping blades 16*b* being advanced or intruded into the solids layer, leading to scraping of the solids. The solids scraped are collected in the groove 13*e* formed on the bottom of the basket 13.

Then, a crystal recovery step is carried out while scraping the crystals as described above. In the crystal recovery step, the solids discharge pipe 17 is lowered, to thereby insert the lower end thereof into the groove 13*e* of the bottom of the basket 13 as shown in FIG. 1. Also, the solenoid valve 58 is driven so as to connect the first port 58*a* of the solenoid valve 58 to the second port 58*b* thereof while keeping the swing section 56*b* of the solids feed and discharge pipe 56 mounted on the rotary drum 23 of the vacuum rotary dryer 3 at the retreat position as shown in FIG. 5A, to thereby connect the solid feed and discharge pipe 56 through the piping 59 to the solids discharge pipe 17 of the centrifugal filtering unit. Further, the solenoid valves 48 and 49 are driven so as to connect the first port 48*a* of the solenoid valve 48 of the vacuum rotary dryer 3 to the third port 48*c* and connect the first port 49*a* of the solenoid valve 49 to the second port 49*b*, to thereby connect the gas flow pipe 46 through the condenser 52 to the pressure reducing unit 53. In addition, the hydraulic cylinder 27 is actuated so as to incline the support frame 22, to thereby position the rear end 22B of the support frame 22 below the front end 22A thereof, resulting in inclining the rotary drum 23 so as to position the other end of the rotary drum 23 in the axial direction above the one end thereof, and then the motor 36 is driven to rotate the rotary drum 23.

Under such conditions, the pressure reducing unit 53 is actuated to suck gas in the rotary drum 23. This causes a reduction in pressure in the rotary drum 23, resulting in suction force being applied to the solids discharge pipe 17 of the centrifugal filtering unit 1, so that solids S in the groove 13*e* of the bottom of the basket 13 may be sucked through the solids discharge pipe 17 for discharge. The solids S discharged through the solids discharge pipe 17 are then fed through the piping 59 and solids feed and discharge pipe 56 into the rotary drum 23. The solids feed and discharge pipe 56 is so arranged that the straight pipe section 56*a* is deviated from the central axis of the rotary drum 23; thus, when the swing section 56*b* of the solids feed and discharge pipe 56 is at the retreat position, a gap G of a large size is defined between the distal end of the swing section 56*b* and the inner surface of the rotary drum 23, to thereby facilitate feed of the solids S from the solids feed and discharge pipe 56 to the rotary drum 13.

When the central axis of the rotary drum 23 is kept oriented horizontally during feed of the solids to the rotary drum 23, solids discharged through the distal end of the swing section 56*b* of the solids feed and discharge pipe 56 are collected right below the swing section 56*b* to form a mountain of the solids, therefore, there is likelihood that the mountain clogs the distal end of the swing section 56*b* before the amount of solids treated in the rotary drum reaches a predetermined level, to thereby keep the solids from discharge.

Figure 5B:
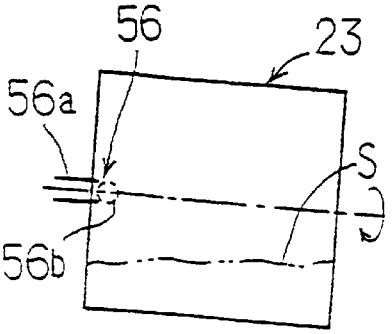

On the contrary, when the rotary drum 23 is rotated to carry out feed of solids to the rotary drum while keeping the rotary drum 23 inclined so as to position the other end of the rotary drum 23 in the axial direction thereof above the one end thereof as shown in FIG. 5B, the solids S discharged from the swing section 56*b* are transferred in a direction away from the swing section 56*b*. This effectively prevents clogging of the distal end of the swing section solids due to collection of solids right below the swing section, to thereby ensure smooth feed of the solids to the rotary drum 23 before the amount of solids S fed to the rotary drum reaches a predetermined level.

Figure 6A:
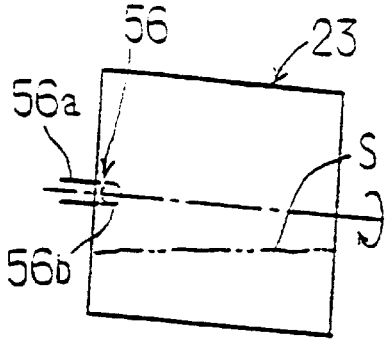
FIGS. 6A and 6B each are a schematic view showing operation of a rotary drum during drying of solids by a vacuum rotary dryer according to the present invention by way of example.
Figure 6B:
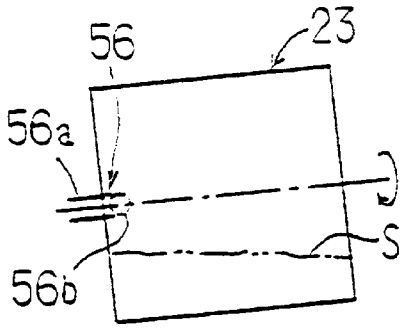

When feed of solids from the centrifugal filtering unit 1 to the rotary drum 23 of the vacuum rotary dryer 3 is completed, operation of the pressure reducing unit 53 is stopped to restart the solid-liquid separation treatment. After the treatment is completed, actuation of the pressure reducing unit 53 is restarted to reduce a pressure in the rotary drum 23, to thereby transfer solids in the basket 13 to the rotary drum 23 by suction. When the operation is repeated, resulting in the amount of solids fed to the rotary drum 23 reaching a predetermined level, the solenoid valve 58 is actuated to cause the other end of the straight pipe section 56*a* of the solid feed and discharge pipe 56 to be closed. Then, the pressure reducing unit 53 is actuated to reduce a pressure in the rotary drum 23, during which the rotary drum is rotated. Concurrently, hot water is fed to the heated-fluid flow passage 23*h* of the outer periphery of the rotary drum 23 through the rotary joint 40 to raise a temperature of the rotary drum to a predetermined level. Such a state is kept for a predetermined period of time, to thereby carry out the drying treatment. The rotary drum 23 may take any desired posture during the drying treatment. The central axis of the rotary drum 23 may be horizontally oriented. Also, during a period of time for which the drying treatment is executed, the piston rod of the hydraulic cylinder 27 may be reciprocated to swing the support frame 22, to thereby swing the rotary drum 23 at a predetermined cycle as shown in FIGS. 6A and 6B. Such pivotal movement of the rotary drum 23 facilitates uniform drying of the solids in the rotary drum 23.

After drying of the solids is completed, feed of hot water to the heated-fluid flow passage 23*h* is interrupted, so that operation of taking the solids out of the rotary drum by suction takes place. The solids removal operation by suction is carried out by connecting the first port 58*a* of the solenoid valve 58 to the third port 58*c* and the other end of the straight pipe section 56*a* of the solids feed and discharge pipe 56 to the piping 65 connected to the solids suction and transport structure 72 and also by connecting the first port 48*a* of the solenoid valve 48 to the second port 48*b* and the other end of the gas flow pipe to the gas space at an atmospheric pressure through the filter 51. Under such conditions, the hydraulic cylinder 27 is actuated to incline the rotary drum so that the other end of the rotary drum 23 in the axial direction thereof (or the end thereof on the side on which the swing section 56*b* is arranged) may be positioned below the one end thereof as shown in FIG. 7B. Then, the vacuum pump 6 is actuated to act suction force on the solids feed and discharge pipe 56 through the piping 65 and the hydraulic cylinder 61 is actuated while keeping the rotary drum 23 rotated, to thereby advance or intrude the distal end of the swing section 56*b* of the solids feed and discharge pipe 56 into the layer of the solids. When the distal end of the swing section 56*b* is thus intruded into the solids, the solids S dried are transported through the solids feed and discharge pipe 56 and piping 65 to the cyclone separator 5 together with a stream of clean air introduced into the rotary drum 23 through the filter 51. Mixed fluid of the solids and air is then separated into the solids and air by swirling flow generated in the separator. The air separated is guided through the filter 7 toward the vacuum pump 6 and the solids are dropped into the product tank 4. The swing section 56*b* of the solids feed and discharge pipe 56 is ultimately pivotally moved to the final suction position shown in FIG. 7A following a reduction in amount of the solids in the rotary drum. Under such conditions, the distal end of the swing section 56*b* is kept in proximity to the inner surface of the peripheral wall of the rotary drum at the corner defined between the lowermost portion of the rotary drum 23 inclined and the end wall of the rotary drum in the axial direction thereof (or the cover 23*d* in the illustrated embodiment). The solids S in the rotary drum, as shown in FIG. 7B, is transferred along the inclined surface of the lower portion of the rotary drum and collected in proximity to the distal end of the swing section 56*b* placed at the final suction position. Thus, the above-described construction permits substantially all solids in the rotary drum 23 to be transferred toward the cyclone separator through the solid feed and discharge pipe 56.

In the illustrated embodiment, the compressed air feed source 54 functions to feed high pressure air through the gas flow pipe 46 into the rotary drum 23, to thereby prevent or eliminate clogging of the filter 47.

Also, the flexible relay pipes 50 and 73 function to permit pivotal movement of the rotary drum 23.

As described above, the illustrated embodiment is so constructed that a pressure in the rotary drum 23 is reduced while keeping the other end of the straight pipe section 56*a* of the solids feed and discharge pipe 56 and the other end of the gas flow pipe 46 respectively connected to the piping 59 connected to the solid discharge pipe 17 of the centrifugal filtering unit and the piping connected to the pressure reducing unit 53, to thereby feed solids in the basket of the centrifugal filtering unit to the rotary drum through the solids discharge pipe, feed and discharge change-over valve and solids feed and discharge pipe arranged in the centrifugal filtering unit. Such construction permits solids to be fed from the basket of the centrifugal filtering unit to the rotary drum 23 of the vacuum rotary dryer without contacting the solids with an ambient atmosphere.

Thus, the present invention permits charging of solids from the solids feed source (or the centrifugal filtering unit in the illustrated embodiment) into the rotary drum, drying of solids in the rotary drum and removal of solids from the rotary drum to be carried out in a system isolated from an ambient atmosphere, to thereby prevent the product from being contacted with an ambient atmosphere or the hands.

Figure 7A:
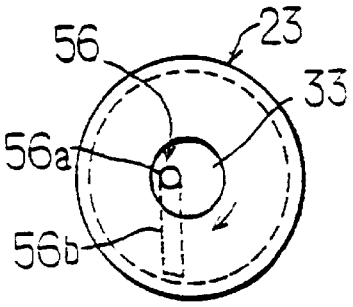
FIGS. 7A and 7B are a side elevation view and a front elevation view each schematically showing an essential part of a vacuum rotary dryer according to the present invention together with a manner of operation of taking solids out of from a rotary drum of the dryer, respectively.
Figure 7B:
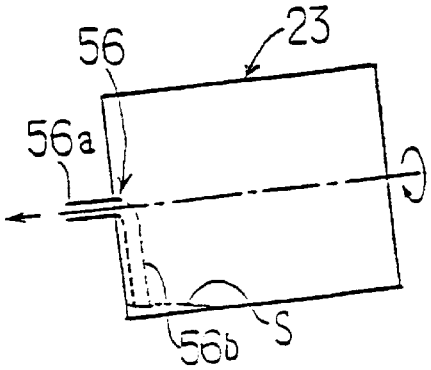

In the illustrated embodiment, the final suction position of the swing section 56*b* of the solids feed and discharge pipe 56 is set right below the straight pipe section 56*a* as shown in FIG. 7A, so that the distal end of the swing section 56*b* is slightly deviated from the lowermost portion of the rotary drum 23 at the final suction position. In this instance, the rotary drum 23 is preferably rotated (in a clockwise direction in FIG. 7A) so as to approach solids present at the lowermost portion of the peripheral wall of the rotary drum 23 to the distal end of the swing section 56*b* of the solids feed and discharge pipe 56 at the final suction position.

Figure 8A:
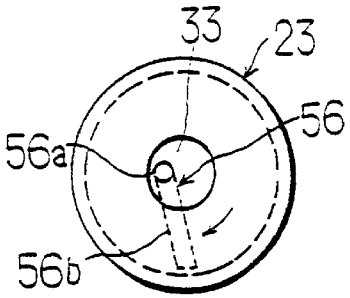
Figure 8B:
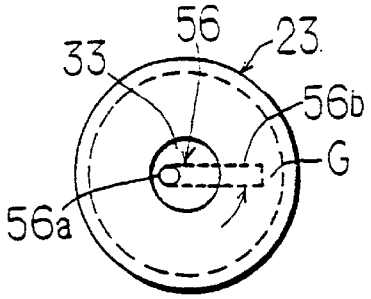

The present invention is not limited to the construction wherein the final suction position of the swing section 56*b* is set as described above. For example, as shown in FIG. 8A, the swing section 56*b* may be increased in length, to thereby render the distal end of the swing section 56*b* opposite to the peripheral wall of the rotary drum at the lowermost portion of the inclined rotary drum 23 when the swing section 56*b* is at the final suction position. In this instance as well, the retreat position of the swing section may be defined at a position at which the swing section 56*b* is substantially horizontally oriented as shown in FIG. 8B.

Figure 9A:
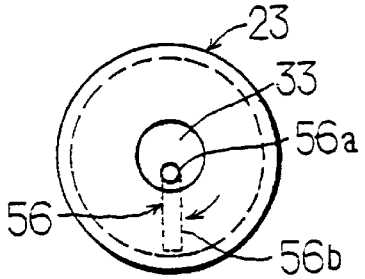
Figure 9B:
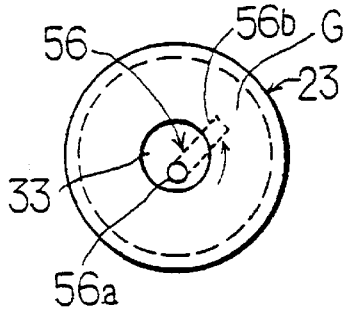

Also, as shown in FIG. 9A, the straight pipe section 56*a* of the solids feed and discharge pipe 56 may be arranged so as to extend through the feed and discharge support member 33 at a position downwardly deviated from the central axis of the rotary drum 23, to thereby define the final suction position at a position which permits the swing section 56*b* to be vertically downwardly oriented. In this instance, the retreat position of the swing section 56*b* is preferably set at a position at which it is obliquely upwardly inclined from the horizontal direction as shown in FIG. 9B.

In the illustrated embodiment, the solids feed and discharge pipe 56 is constructed of the straight pipe section 56*a* and swing section 56*b* connected to each other so as to define an L-shape, wherein the straight pipe section 56*a* is arranged at a position deviated from the central axis of the rotary drum 23. However, the present invention is not limited to such arrangement of the solids feed and discharge pipe.

Figure 10:
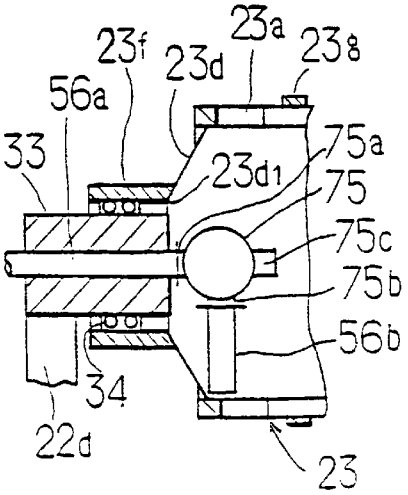
FIG. 10 is a sectional view showing an essential part of a further modification of a solids feed and discharge pipe arranged in a vacuum rotary dryer according to the present invention.

For example, as shown in FIG. 10, the straight pipe section 56*a* of the solids feed and discharge pipe 56 may be arranged coaxially with the central axis of the rotary drum 23, resulting in the end of the straight pipe section 56*a* positioned in the rotary drum being connected to the first port 75*a* of the solenoid valve 75 and the swing section 56*b* being connected to the second port 75*b* of the solenoid valve 75 open in a direction perpendicular to the axis of the straight pipe section 56*a*. In this instance, the third port 75*c* of the solenoid valve 75 is rendered open, for example, in the axial direction of the rotary drum, resulting in the third port 75*c* acting as an outlet for feed of solids to the rotary drum.

In the illustrated embodiment, the pressure reducing unit 53 is constituted by a vacuum pump. The pressure reducing unit may be constituted by any suitable means other than a vacuum pump, so long as it can suck gas in the rotary drum to reduce a pressure in the drum.

In the illustrated embodiment, the cyclone separator is used as a separation means for mixed fluid of solids and air removed from the rotary drum of the vacuum rotary dryer into the solids and air. This facilitates separation of the solids and air from each other while keeping the structure simplified. Nevertheless, the separation means may be constituted by any other suitable means.

INDUSTRIAL APPLICABILITY

As can be seen from the foregoing, the present invention is so constructed that a pressure in rotary drum is reduced to feed solids to be dried to the rotary drum while keeping the solids feed and discharge pipe and gas flow pipe respectively connected to the piping connected to the solids feed source and the piping connected to the pressure reducing unit. This permits feed of solids to the rotary drum to be carried out while keeping the solids from being contacted with an ambient atmosphere and the hands. Also, in the present invention, removal of solids from the rotary drum is carried out by sucking solids out of the rotary drum while keeping the rotary drum inclined and pivotally moving the swing section of the solid feed and discharge pipe to the lowermost portion of the rotary drum, resulting in substantially all solids being removed from the rotary drum without requiring any manual operation. Further, in the present invention, removal of solids from the rotary drum is carried out by respectively connecting the solids feed and discharge pipe and gas flow pipe to the piping connected to the solids suction and transport structure and the gas space at an atmospheric pressure to suck solids from the rotary drum. Thus, solids may be taken out of the rotary drum while keeping the solids from being contacted with an ambient atmosphere and the hands.

Thus, the present invention permits feed of solids to the rotary drum, drying of the solids and removal of the solids to be carried out in a system isolated from an ambient atmosphere without requiring any manual operation, to thereby provide a product free of any deterioration in quality and contamination. Thus, the present invention is highly useful to drying of products in a field of fine chemicals such as manufacturing of pharmaceuticals.

I claim:

1. A vacuum rotary dryer for drying particulate solids, comprising:

a rotary drum supported so as to be varied in inclination angle at which a central axis thereof acting as a center of rotation thereof is inclined with respect to a horizontal direction in a vertical plane;

a drum inclination angle adjusting structure for adjusting the inclination angle of the central axis of said rotary drum;

a drum rotating driver for driving said rotary drum to rotate it;

a gas flow pipe arranged so as to airtightly extend through a central portion of one end of said rotary drum in an axial direction thereof into said rotary drum while permitting rotation of said rotary drum;

a pressure reducing unit for sucking gas in said rotary drum to reduce a pressure in said rotary drum;

a gas flow passage change-over structure for connecting said gas flow pipe to a piping connected to said pressure reducing unit and a gas space at an atmospheric pressure while carrying out change-over thereof;

a solids feed and discharge pipe including a straight pipe section having one end inserted into said rotary drum from a side of the other end of said rotary drum in the axial direction thereof while permitting rotation of said rotary drum and a swing section arranged so as to extend from the one end of said straight pipe section positioned in said rotary drum toward a peripheral wall of said rotary drum and communicate with said straight pipe section;

a feed and discharge pipe drive structure arranged so as to rotate said straight pipe section of said solids feed and discharge pipe to pivotally move said swing section in said rotary drum;

a feed and discharge change-over structure for connecting said straight pipe section of said solids feed and discharge pipe to a piping connected to a feed source of solids to be dried and a piping connected to a solids suction and transport structure for transporting dried solids by suction while carrying out change-over thereof; and a drum heating structure for heating said rotary drum to dry solids in said rotary drum;

said drum inclination angle adjusting structure varying the inclination angle of the central axis of said rotary drum;

said swing section of said solids feed and discharge pipe being arranged so as to be pivotally movable between a final suction position at which a distal end of said swing section approaches a corner between an end wall of said rotary drum on a side of the other end of said rotary drum in the axial direction thereof and a lower portion of said rotary drum and a retreat position at which said swing section is retreated from said final suction position.

2. A vacuum rotary dryer as defined in claim 1, characterized in that said vacuum rotary dryer further comprises a control unit;

wherein said control unit is constructed so as to control said drum rotating driver, feed and discharge change-over structure, gas flow passage change-over structure, pressure reducing unit, solids suction and transport structure, drum inclination angle adjusting structure, feed and discharge pipe drive structure, and drum heating structure in such a manner that solids feed operation of reducing a pressure in said rotary drum to feed solids to be dried from said solids feed source to said rotary drum through said solids feed and discharge pipe while keeping the central axis of said rotary drum inclined so as to position said the other end of said rotary drum above the one end thereof and keeping the other end of said straight pipe section of said solids feed and discharge pipe and the other end of said gas flow pipe respectively connected to said piping connected to said solids feed source and said piping connected to said pressure reducing unit; drying operation of closing the other end of said straight pipe section of said solids feed and discharge pipe to rotate said rotary drum while keeping the other end of the gas flow pipe connected to said pressure reducing unit and carrying out a reduction in pressure in said rotary drum by said pressure reducing unit, and heating of said rotary drum by said drum heating structure to dry solids in said rotary drum, when the solids feed operation is attained a predetermined number of times to permit the amount of solids in said rotary drum to reach a predetermined level; and suction and discharge operation of carrying out suction and discharge of solids in said rotary drum by said solids suction and transport structure while pivotally moving said swing section of said solids feed and discharge pipe toward the final suction position, while keeping the other end of said straight pipe section of said solid feed and discharge pipe and the other end of said gas flow pipe respectively connected to said piping connected to said solids suction and transport structure and said gas space at an atmospheric pressure and keeping the central axis of said rotary drum inclined so as to position said the other end of said rotary drum below the one end thereof may be carried out.

3. A vacuum rotary dryer for drying particulate solids, comprising:

a rotary drum supported so as to be varied in inclination angle at which a central axis thereof acting as a center of rotation thereof is inclined with respect to a horizontal direction in a vertical plane;

a drum inclination angle adjusting structure for adjusting the inclination angle of the central axis of said rotary drum;

a drum rotating driver for driving said rotary drum to rotate it;

a gas flow pipe arranged so as to airtightly extend through a central portion of one end of said rotary drum in an axial direction thereof into said rotary drum while permitting rotation of said rotary drum;

a solids passage preventing filter for preventing solids in said rotary drum from flowing out through said gas flow pipe;

a pressure reducing unit for sucking gas in said rotary drum to reduce a pressure in said rotary drum;

a gas flow passage change-over structure for connecting the other end of said gas flow pipe to a piping connected to said pressure reducing unit when solids to be dried are fed to said rotary drum and when solids in said rotary drum are dried and connecting the other end of said gas flow pipe to a gas space at an atmospheric pressure while carrying out change-over thereof when solids in said rotary drum are taken out of said rotary drum;

a solids feed and discharge pipe including a straight pipe section having one end inserted into said rotary drum from a side of the other end of said rotary drum in the axial direction thereof while permitting rotation of said rotary drum and a swing section arranged so as to extend from the one end of said straight pipe section positioned in said rotary drum toward a peripheral wall of said rotary drum and communicate with said straight pipe section;

a feed and discharge pipe drive structure arranged so as to rotate said straight pipe section of said solids feed and discharge pipe to pivotally move said swing section in said rotary drum;

a feed and discharge change-over structure for connecting the other end of said straight pipe section of said solids feed and discharge pipe to a piping connected to a feed source of solids to be dried when solids to be dried are fed to said rotary drum, closing the other end of said straight pipe section when solids in said rotary drum are dried, and connecting the other end of said straight pipe section to a piping connected to a solids suction and transport structure for transporting dried solids by suction when solids in said rotary drum are taken out of said rotary drum; and a drum heating structure for heating said rotary drum to dry solids in said rotary drum;

said drum inclination angle adjusting structure varying the inclination angle of the central axis of said rotary drum so that the other end of said rotary drum is positioned above the one end thereof when solids are fed to said rotary drum and the other end of said rotary drum is positioned below the one end thereof when solids in said rotary drum are taken out of said rotary drum;

said swing section of said solids feed and discharge pipe being arranged so as to be pivotally movable between a final suction position at which a distal end of said swing section approaches a corner between an end wall of said rotary drum on a side of the other end of said rotary drum and a lower portion of a peripheral wall of said rotary drum and a retreat position at which said swing section is away from said final suction position;

said feed and discharge pipe drive structure positioning said swing section of said solids feed and discharge pipe at the retreat position when solids are fed to said rotary drum and pivotally moving a distal end of said swing section of said solids feed and discharge pipe to said final suction position while intruding said distal end into solids in said rotary drum when solids in said rotary drum are taken out thereof.

4. A vacuum rotary dryer as defined in claim 3, characterized in that said vacuum rotary dryer further comprises a control unit;

wherein said control unit is constructed so as to control said drum rotating driver, feed and discharge change-over structure, gas flow passage change-over structure, pressure reducing unit, solids suction and transport structure, drum inclination angle adjusting structure, feed and discharge pipe drive structure, and drum heating structure in such a manner that solids feed operation of reducing a pressure in said rotary drum to feed solids to be dried from said solids feed source to said rotary drum through said solids feed and discharge pipe while keeping the central axis of said rotary drum inclined so as to position said the other end of said rotary drum above the one end thereof and keeping the other end of said straight pipe section of said solids feed and discharge pipe and the other end of said gas flow pipe respectively connected to said piping connected to said solids feed source and said piping connected to said pressure reducing unit; drying operation of closing the other end of said straight pipe section of said solids feed and discharge pipe to rotate said rotary drum while keeping the other end of the gas flow pipe connected to said pressure reducing unit and carrying out a reduction in pressure in said rotary drum by said pressure reducing unit, and heating of said rotary drum by said drum heating structure to dry solids in said rotary drum, when the solids feed operation is attained a predetermined number of times to permit the amount of solids in said rotary drum to reach a predetermined level; and suction and discharge operation of carrying out suction and discharge of solids in said rotary drum by said solids suction and transport structure while pivotally moving said swing section of said solids feed and discharge pipe toward the final suction position, while keeping the other end of said straight pipe section of said solid feed and discharge pipe and the other end of said gas flow pipe respectively connected to said piping connected to said solids suction and transport structure and said gas space at an atmospheric pressure and keeping the central axis of said rotary drum inclined so as to position said the other end of said rotary drum below the one end thereof may be carried out.

5. A vacuum rotary dryer for drying particulate solids, comprising:

a rotary drum supported so as to be varied in inclination angle at which a central axis thereof acting as a center of rotation thereof is inclined with respect to a horizontal direction in a vertical plane;

a drum rotating driver for driving said rotary drum to rotate it;

a gas flow pipe arranged so as to airtightly extend through a central portion of one end of said rotary drum in an axial direction thereof into said rotary drum while permitting rotation of said rotary drum;

a solids passage preventing filter for preventing solids in said rotary drum from flowing out through said gas flow pipe;

a pressure reducing unit for sucking gas in said rotary drum to reduce a pressure in said rotary drum;

a gas flow passage change-over structure for connecting the other end of said gas flow pipe to said pressure reducing unit when solids to be dried are fed to said rotary drum and when solids in said rotary drum are dried and connecting the other end of said gas flow pipe to a gas space at an atmospheric pressure while carrying out change-over thereof when solids in said rotary drum are taken out of said rotary drum;

a feed and discharge pipe support member arranged coaxially with the central axis of said rotary drum and coupled to a central portion of the other end of said rotary drum in the axial direction thereof while permitting rotation of said rotary drum;

a solids feed and discharge pipe including a straight pipe section arranged in a manner to rotatably extend through said feed and discharge pipe support member at a position deviated from the central axis of said rotary drum and having one end inserted into said rotary drum and a swing section arranged so as to extend from the one end of said straight pipe section positioned in said rotary drum toward a peripheral wall of said rotary drum and communicate with said straight pipe section;

a feed and discharge pipe drive structure arranged so as to rotate said straight pipe section of said solids feed and discharge pipe to pivotally move said swing section in said rotary drum;

a feed and discharge change-over structure for connecting the other end of said straight pipe section of said solids feed and discharge pipe to a piping connected to a feed source of solids to be dried when solids to be dried are fed to said rotary drum, closing the other end of said straight pipe section when solids ion said rotary drum are dried, and connecting the other end of said straight pipe section to a piping connected to a solids suction and transport structure for transporting dried solids by suction when solids in said rotary drum are taken out of said rotary drum;

a drum heating structure for heating said rotary drum to dry solids in said rotary drum; and a drum inclination angle adjusting structure for varying the inclination angle of the central axis of said rotary drum so that the other end of said rotary drum is positioned above the one end thereof when solids are fed to said rotary drum and the other end of said rotary drum is positioned below the one end thereof when solids in said rotary drum are taken out of said rotary drum;

said swing section of said solids feed and discharge pipe being arranged so as to be pivotally movable between a final suction position at which a distal end of said swing section approaches a corner between an end wall of said rotary drum on a side of the other end of said rotary drum and a lower portion of said rotary drum and a retreat position at which said swing section is retreated from said final suction position;

said feed and discharge pipe drive structure positioning said swing section of said solids feed and discharge pipe at the retreat position when solids are fed to said rotary drum and pivotally moving a distal end of said swing section of said solids feed and discharge pipe to said final suction position while intruding said distal end into solids in said rotary drum when solids in said rotary drum are taken out thereof.

6. A vacuum rotary dryer as defined in claim 5, characterized in that said vacuum rotary dryer further comprises a control unit;

wherein said control unit is constructed so as to control said drum rotating driver, feed and discharge change-over structure, gas flow passage change-over structure, pressure reducing unit, solids suction and transport structure, drum inclination angle adjusting structure, feed and discharge pipe drive structure, and drum heating structure in such a manner that solids feed operation of reducing a pressure in said rotary drum to feed solids to be dried from said solids feed source to said rotary drum through said solids feed and discharge pipe while keeping the central axis of said rotary drum inclined so as to position said the other end of said rotary drum above the one end thereof and keeping the other end of said straight pipe section of said solids feed and discharge pipe and the other end of said gas flow pipe respectively connected to said piping connected to said solids feed source and said piping connected to said pressure reducing unit; drying operation of closing the other end of said straight pipe section of said solids feed and discharge pipe to rotate said rotary drum while keeping the other end of the gas flow pipe connected to said pressure reducing unit and carrying out a reduction in pressure in said rotary drum by said pressure reducing unit, and heating of said rotary drum by said drum heating structure to dry solids in said rotary drum, when the solids feed operation is attained a predetermined number of times to permit the amount of solids in said rotary drum to reach a predetermined level; and suction and discharge operation of carrying out suction and discharge of solids in said rotary drum by said solids suction and transport structure while pivotally moving said swing section of said solids feed and discharge pipe toward the final suction position, while keeping the other end of said straight pipe section of said solid feed and discharge pipe and the other end of said gas flow pipe respectively connected to said piping connected to said solids suction and transport structure and said gas space at an atmospheric pressure and keeping the central axis of said rotary drum inclined so as to position said the other end of said rotary drum below the one end thereof may be carried out.

* * * * *